US005618164A

United States Patent [19]

Holzheimer et al.

[11] Patent Number: 5,618,164

[45] Date of Patent: Apr. 8, 1997

[54] LIQUID RING COMPRESSOR WITH PLURAL AFTER-COOLER ELEMENTS

[75] Inventors: Guenter Holzheimer, Baiersdorf; Bernd Schaeperklaus, Neuenkirchen; Hans Weigl, Velburg, all of Germany

[73] Assignee: Siemens Aktiengesellschaft, Munich, Germany

[21] Appl. No.: 567,662

[22] Filed: Dec. 5, 1995

[30] Foreign Application Priority Data

Dec. 6, 1994 [DE] Germany ..... 44 43 429.4
Mar. 31, 1995 [DE] Germany ..... 295 05 608.8

[51] Int. Cl.[6] ..... F04C 19/00

[52] U.S. Cl. ..... 417/68

[58] Field of Search ..... 417/68, 69

[56] References Cited

U.S. PATENT DOCUMENTS 4,484,457 11/1984 Mugele ..... 417/69
4,657,487 4/1987 Schonwald et al. ..... 417/68
4,711,771 12/1987 Schiller .
4,725,210 2/1988 Suzuki .
5,511,953 4/1996 Holzheimer et al. ..... 417/68

FOREIGN PATENT DOCUMENTS 486726 5/1992 European Pat. Off. ..... 417/68
4327003 8/1994 Germany .

*Primary Examiner*—Timothy Thorpe
*Assistant Examiner*—Roland G. McAndrews, Jr.
*Attorney, Agent, or Firm*—Kenyon & Kenyon

[57] ABSTRACT

The invention relates to a compressor assembly, where the inlet port of a liquid-piston rotary compressor is coupled to a suction line and the outlet port of the compressor is coupled to a storage tank. An air-discharge line and a return line leading to the liquid-piston rotary compressor are coupled to the storage tank which recirculate operating liquid. Furthermore, an after-cooler device having a primary and a secondary zone is provided, which is connected with its primary zone to the suction line and, its secondary zone, to the air-discharge line. The condensate being produced in the after-cooler device is recirculated into the circulation zone of the operating liquid. A complete, or at least a nearly complete reduction in the consumption of operating liquid is achieved in that a second or additional after-cooler device is coupled in series, in terms of flow, with the first after-cooler device, and the condensate being produced in the additional after-cooler device is also recirculated as operating liquid in the compressor assembly.

5 Claims, 1 Drawing Sheet

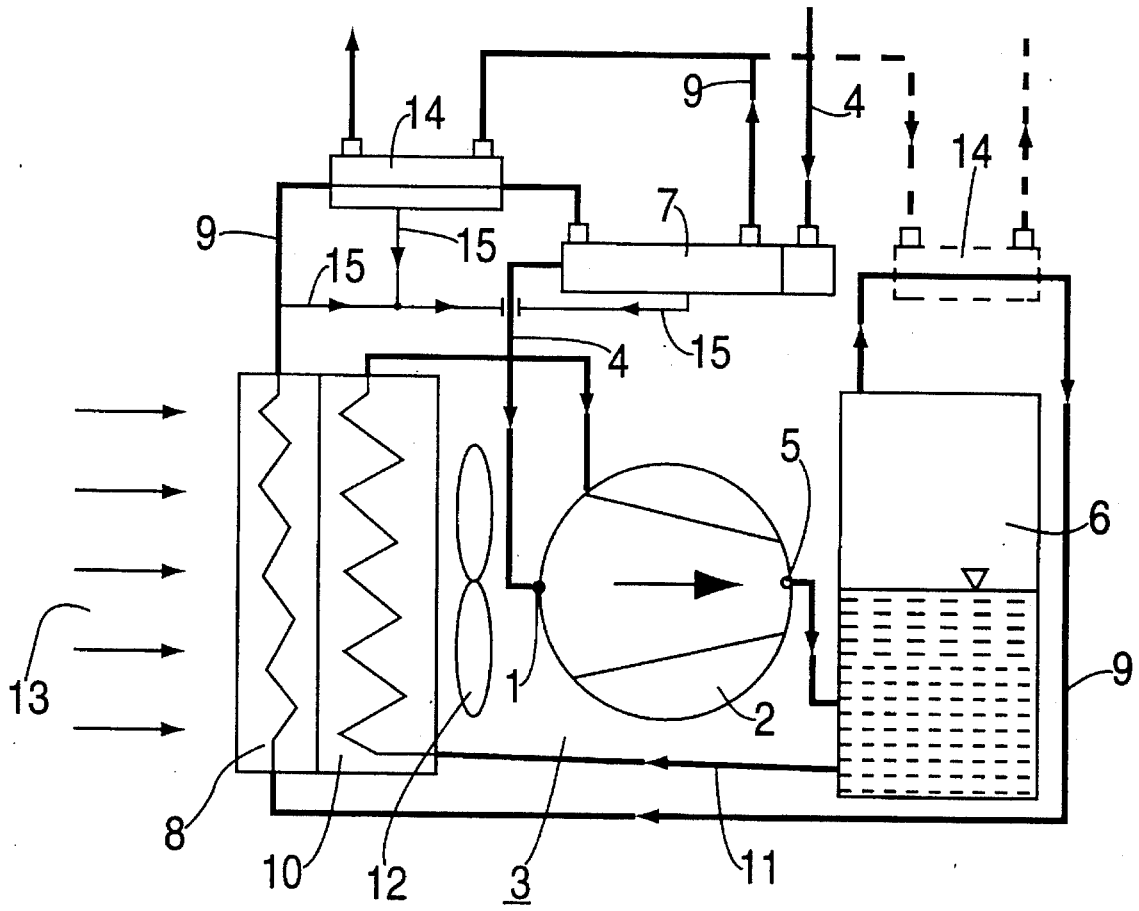
14
9
4
14
7
9
15
15
15
4
5
6
13
1
2
9
8
10
12
3
11

LIQUID RING COMPRESSOR WITH PLURAL AFTER-COOLER ELEMENTS

BACKGROUND OF THE INVENTION

The present invention pertains to a compressor assembly. More particularly the present invention pertains to a compressor assembly having a liquid-piston rotary compressor connected with its inlet port to a suction line and, with its outlet port, to a storage tank. An air-discharge line and a return line are connected to the storage tank and lead to the liquid-piston rotary compressor. The air-discharge line and return line recirculate operating liquid. A first after-cooler device, having a primary and a secondary zone, is connected with its primary circuit to the suction line and its secondary zone is connected to the air-discharge line. The condensate produced in the after-cooler device is recirculated as operating liquid.

A unit of this type is described in German Patent No. C-43 27 003. In this assembly, the outgoing air flowing out of the storage tank is fed to an after-cooler device, through which the intake air is also directed. Thus, a heat exchange takes place between the cooler intake air and the outgoing air warmed by the compression process, which results in a cooling of the outgoing air. This cooling causes a portion of the water vapor contained in the outgoing air to condense. The condensed water is recirculated into the operating liquid circulation circuit, so that the consumption of operating liquid is reduced. In spite of this reduction in the amount of operating liquid consumed, operating liquid still has to be added from time to time. It has been shown that designing the after-cooler device with larger dimensions does not substantially improve the efficiency of precipitating water vapor out of the outgoing air.

Therefore, an object of the present invention is to provide a compressor assembly of the type mentioned above so as to render possible a complete, or at least a nearly complete reduction in the consumption of operating liquid.

SUMMARY OF THE INVENTION

This and other objects are solved by the compressor of the present invention. At least one additional (or second) after-cooler device is connected in series, in terms of flow, with the first after-cooler device of the compressor assembly. The condensate being produced in the additional after-cooler device is also recirculated as operating liquid. A further cooling of the outgoing air and, thus, a further precipitation of water vapor out of the outgoing air is achieved by the additional after-cooler device.

The water vapor carried along in the outgoing air is precipitated quite effectively by arranging the additional after-cooler device upstream from the first after-cooler device, viewed in the direction of flow.

Costs related to space and production can be reduced because the first and the additional after-cooler device are combined into one basic unit.

A further improvement in the precipitation efficiency is achieved in accordance with a further embodiment of the present invention in that a third after-cooler device is provided, which, with its secondary zone, is connected in series, in terms of flow, with the secondary circuit of the first and additional after-cooler device, and its primary circuit is connected to the air-discharge line of the secondary circuit of the first after-cooler device.

Structurally combining the first and the third after-cooler devices, or even all after-cooler devices, makes it possible to reduce the need for conduit means.

In the case of one compressor assembly, where a heat exchanger that receives a cooling air stream is arranged in the return line, it is not necessary to have a separate cooling air stream for the additional after-cooler device, because this after-cooler device is situated in the cooling air stream of the heat exchanger. In this case, the additional after-cooler device can be structurally combined with the heat exchanger, resulting in considerable space savings.

Without entailing any additional expenditure, another way to achieve cooling is to place the storage tank in the cooling air stream of the heat exchanger. The cooling effect can be further improved by providing the storage tank at least partially with cooling ribs.

BRIEF DESCRIPTION OF THE DRAWING FIGURE

The sole drawing FIGURE shows an exemplary embodiment of a compressor assembly constructed according to the present invention.

DETAILED DESCRIPTION

Referring to the sole drawing FIGURE, a suction line 4 is connected to the inlet port 1 of the liquid-piston rotary compressor 2 of the compressor assembly 3. The outlet port 5 of the liquid-piston rotary compressor 2 is connected to a storage tank 6. The medium (e.g., air) to be compressed, including a portion of the operating liquid, is discharged via the outlet port 5 and supplied to the storage tank 6.

A first after-cooler unit 7 is divided into a primary and secondary zone. The primary zone in this case is the zone of the cooling unit that admits the cooling medium, and the secondary zone admits the medium to be cooled. The primary zone of the first after-cooler unit 7 feeds into the suction line 4. In other words, the medium to be compressed by the liquid-piston rotary compressor 2 (air, for example) flows through the first after-cooler unit 7 before entering into the liquid-piston rotary compressor 2. The secondary zone of the first after-cooler unit 7 is connected via a second or additional after-cooler unit 8 to the air-discharge line 9 of the storage tank 6. The additional after-cooler unit 8 is arranged upstream from the first after-cooler unit 7, viewed in the direction of flow.

A third after-cooler unit 14 can also be arranged between the second after-cooler unit 8 and the first after-cooler unit 7. However, viewed in the direction of flow, the third after-cooler unit 14 can also be arranged upstream from the second after-cooler unit 8, as indicated by the dotted line. The third after-cooler unit 14 is connected with its primary zone to the air-discharge line 9 of the storage tank 6, thus to the discharge line of the secondary zone of the first after-cooler unit 7.

In addition, the compressor assembly 3 has a heat exchanger 10, which is connected to a return line 11 for the operating liquid leading from the storage tank 6 to the liquid-piston rotary compressor 2. Associated with the heat exchanger 10 is a ventilator 12, which produces a cooling air stream 13 that flows through the heat exchanger 10. The second after-cooler unit 8 is joined structurally to this heat exchanger 10, so that the second after-cooler unit 8 is likewise traversed by the flow of the cooling air current 13. This can be achieved by disposing these elements axially in front of one another or also vertically above one another.

The condensate being produced in the after-cooler units 7, 8 and 14 is recirculated by lines 15 into the circulation circuit of the operating liquid.

During operation of the compressor assembly 3, the outgoing air flowing out of the storage tank 6 initially flows through the second after-cooler unit 8 and is thereby cooled, which causes a portion of the water vapor contained in the outgoing air to condense. A further cooling of the outgoing air and, therefore, a further condensation of water vapor follows subsequently in the third and first after-cooler units 14 and 7. The working capacity of the first after-cooler unit 7 can be substantially increased, for example, by injecting a vaporizable liquid, as the operating liquid used in the liquid-piston rotary compressor 2. Given a proper working capacity of the first after-cooler unit 7, it is possible for the outgoing air to be cooled in such a way that the ratio of water vapor still contained in the outgoing air when it exits the after-cooler unit 7 or the third after-cooler unit 14 is not greater than the ratio of water vapor when the intake air enters into the first after-cooler unit 7. Consequently, there is no more consumption of water at all.

Zero water consumption can be achieved in the described compressor assembly, particularly in the case of a compressor operation as well, which is considerably more problematic than vacuum operation with respect to retrograde condensation. During operation of the compressor assembly, even excess condensation can occur, so that, in some instances, the entire condensate volume does not have to be fed back into the operating liquid circulation circuit, rather, if need be, operating liquid must then be drained from the storage tank 6.

Another method for cooling can be achieved without additional expenditure by arranging the storage tank 6 in the cooling air stream of the heat exchanger 10. This can be achieved, in particular, by designing the compressor assembly as one basic unit, through an appropriate constructional arrangement of the storage tank in the basic unit. The storage tank can also be advantageously provided with cooling ribs that enlarge its surface area.

The method of functioning of the compressor assembly has been described for cases where water is used as an operating liquid. However, it is equally possible to use other liquids as operating liquids, instead of water. This does not change the fundamental method of functioning of the assembly.

We claim:

1. A compressor assembly, comprising:

a suction line;

a storage tank;

a liquid-piston rotary compressor having an inlet port and an outlet port, the inlet port of said rotary compressor being coupled to said suction line and the outlet port of said rotary compressor being coupled to said storage tank;

an air-discharge line coupled to said storage tank;

a return line coupled to said storage tank, said return line recirculating operating liquid from said storage tank to said liquid-piston rotary compressor;

a first after-cooler device having a primary and a secondary zone, where said suction line is coupled to the primary zone of said first after-cooler device and said air-discharge line is coupled to the secondary zone of said first after-cooler device, such that condensate produced in said first after-cooler device is recirculated as operating liquid in said compressor assembly;

a second after-cooler device coupled to said first after-cooler device and having primary zone and a secondary zone, such that condensate being produced in the second after-cooler device is recirculated as operating liquid in said compressor assembly, said second after-cooler device being arranged upstream, in terms of air discharge flow, from said first after-cooler device; and a third after-cooler device having a primary zone and a secondary zone, where the secondary zone of said third after-cooler device is coupled to the secondary zone of said first and second after-cooler device, and the primary zone of third after-cooler device is connected to the air-discharge line of the secondary zone of said first after-cooler device.

2. The compressor assembly of claim 1, further comprising:

a heat exchanger receiving a cooling air stream, such that said heat exchanger is arranged in said return line that recirculates operating liquid, and said second after-cooler device is located in the cooling air stream of said heat exchanger.

3. The compressor of claim 2, wherein said storage tank is located in the cooling air stream of said heat exchanger.

4. A compressor assembly, comprising:

a suction line;

a storage tank;

a liquid-piston rotary compressor having an inlet port and an outlet port, the inlet port of said rotary compressor being coupled to said suction line and the outlet port of said rotary compressor being coupled to said storage tank;

an air-discharge line coupled to said storage tank;

a return line coupled to said storage tank, said return line recirculating operating liquid from said storage tank to said liquid-piston rotary compressor;

a first after-cooler device having a primary and a secondary zone, where said suction line is coupled to the primary zone of said first after-cooler device and said air-discharge line is coupled to the secondary zone of said first after-cooler device, such that condensate produced in said first after-cooler device is recirculated as operating liquid in said compressor assembly;

a second after-cooler device coupled to said first after-cooler device and having a primary zone and a secondary zone, such that condensate being produced in the second after-cooler device is recirculated as operating liquid in said compressor assembly, said second after-cooler device being arranged upstream, in terms of air discharge flow, from said first after-cooler device; and a heat exchanger receiving a cooling air stream, such that said heat exchanger is arranged in said return line that recirculates operating liquid, and said second after-cooler device is located in the cooling air stream of said heat exchanger.

5. The compressor of claim 4, wherein said storage tank is located in the cooling air stream of said heat exchanger.

* * * * *